United States Patent [19]

Olson

[11] Patent Number: 4,623,112

[45] Date of Patent: Nov. 18, 1986

[54] SUPPORT FOR A BEVERAGE CONTAINER

[76] Inventor: Lorimer Olson, Box 40, Strongfield, Saskatchewan, Canada, S0H 3Z0

[21] Appl. No.: 749,995

[22] Filed: Jul. 1, 1985

[30] Foreign Application Priority Data

Jul. 5, 1984 [CA] Canada ..... 458153

[51] Int. Cl.[4] ..... A47G 23/02

[52] U.S. Cl. ..... 248/153; 248/175; 248/205.3

[58] Field of Search ..... 248/153, 146, 346.1, 248/346, 311.2, 314, 205.3; D9/369; D7/6, 45; 47/41 R

[56] References Cited

U.S. PATENT DOCUMENTS

| | | | |
|---|---|---|---|
| 2,215,411 | 9/1940 | Sebring | 248/311.2 |
| 2,250,361 | 7/1941 | Cullinan | 248/146 |
| 2,634,070 | 4/1953 | Aguettaz | 248/153 X |
| 3,393,892 | 7/1968 | Buck | 248/346.1 |
| 3,800,449 | 4/1974 | Minatodani et al. | 248/205.3 X |
| 3,913,876 | 10/1975 | McSherry | 248/205.3 X |
| 4,359,786 | 11/1982 | Rosberg et al. | 248/311.2 X |

*Primary Examiner*—Ramon O. Ramirez

*Attorney, Agent, or Firm*—Stanley G. Ade; Adrian D. Battison

[57] ABSTRACT

A support for a beverage container comprises a base having on the underside a layer of adhesive which is covered by paper so that it can be removed and then applied to a suitable surface. From the base is a plurality of upstanding fingers which curve inwardly and then outwardly so that they can clamp containers of different sizes or dimensions with the fingers flexing outwardly.

1 Claim, 4 Drawing Figures

SUPPORT FOR A BEVERAGE CONTAINER

BACKGROUND OF THE INVENTION

This invention relates to a support for a beverage container.

Drinks or beverages are taken from various types of containers including bottles, cans and various shapes and sizes of cups and glasses. One problem which regularly arises is the provision of a support or stable surface on which the container can be mounted particularly in a vehicle or in other moving or unstable conditions. This problem has not satisfactorily been resolved.

SUMMARY OF THE INVENTION

It is one object of the present invention therefore to provide a simple inexpensive support which can be used to receive a single beverage container and which can be attached to or mounted upon a surface to stably support the container.

According to the invention, therefore, there is provided a support for a single beverage container, comprising a base member, sized to receive only the beverage container, activatible adhesive means on a underside of the base by which the base can be attached to a surface, and a plurality of side support members upstanding from an upper side of the base for engaging and supporting sides of the container, the members being free to flex outwardly so as to accommodate containers of different outside dimensions.

A preferred arrangement of the support is manufactured from wire, which is bent to form at least three separate side support members which are spaced to allow access to the cup to be inserted and removed from the position between the support members and on top of the base.

In order to accommodate different sizes of containers, the side support members from the base incline inwardly to a position of closest approach and then turn outwardly. In this way the position of closest approach can be designed to be less than the transverse extent of the smallest cup or container with which the support is designed to operate so that the support members or fingers engage the cup at this position and hold it stable. When larger cups are inserted, the fingers or support members can flex outwardly to accommodate the larger cup. The flared mouth defined by the outwardly inclined portion allows the cup base to be inserted between the fingers or support members and then causes the flexing movement necessary to insert the cup between the fingers down to the base.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

FIG. 1 illustrates the support comprising a base 10 and upstanding fingers or side support members 11.

The fingers or side support members are formed from wire bent into shape from a single integral piece which is then embedded in the base 10 to the wire interconnecting portions illustrated at 12 in phantom within the base are rigidly held by the base thus supporting the wire fingers 11 upwardly from the base.

Figure 2:
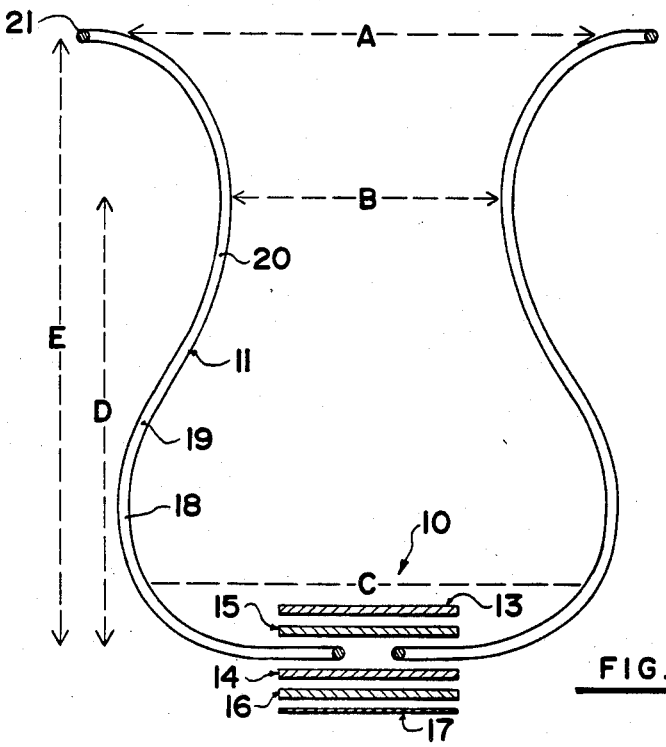
FIG. 2 is a side elevational view partly exploded of the support of FIG. 1.

As shown in FIG. 2, the base is formed from a first circular flat plate member 13 which can conveniently be formed from cardboard which is attached to a second similar plate member 14 by an intervening double sided adhesive tape again of circular shape and indicated at 15. The wires and particularly the interconnecting portions 12 are trapped between the adhesive layer 15 and the plate 14 to be held securely in place. In order to locate the wires during manufacture, four holes are provided in the plates 13 and 14 so that pins can be passed through the plates to hold the inner curved edge of the interconnecting portions 12 at a specific location within the base.

Figure 3:
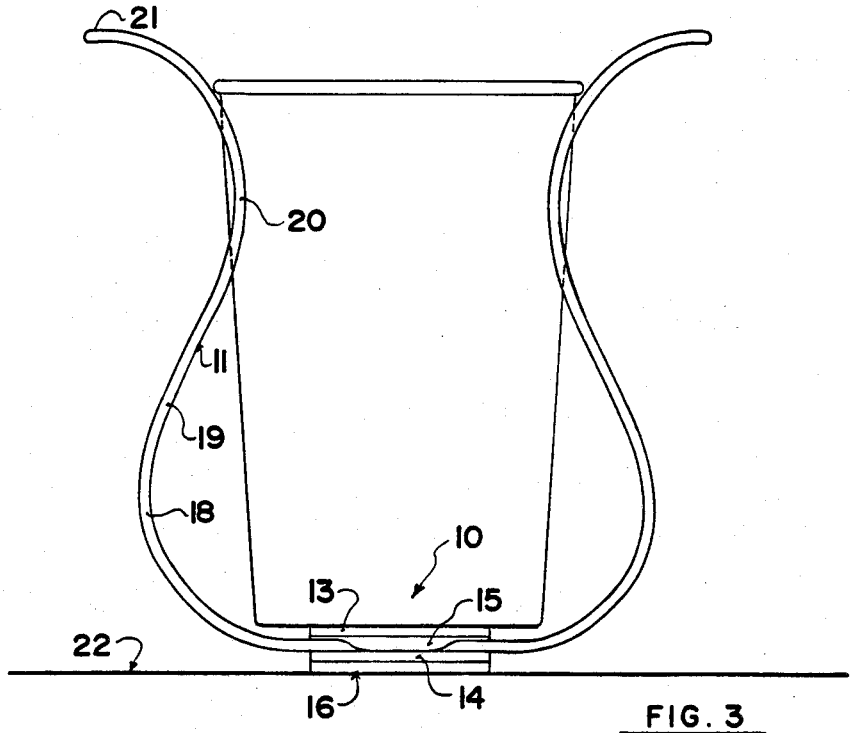
FIG. 3 is a side elevational view similar to FIG. 2 showing the support including a cup.

A second double sided adhesive layer 16 is provided on the underside of the cardboard plate 14 and this in turn is covered by a paper layer 17 so that the adhesive on the layer 16 is normally covered but can be readily exposed or activated in order to attach the base to a suitable surface as illustrated in FIG. 3.

As shown in cross section in FIG. 2, the upstanding wire fingers 11 extend outwardly from the sides of the base and then curve generally upwardly at 18. Above the upward extent 18 the wires curve inwardly at 19 to a position of closest approach indicated at 20 and then curve again outwardly to an upper edge or open mouth indicated at 21. As shown in FIG. 2 these dimensions are achieved by smooth curvature in the wires 11 whereas it is possible to provide the same dimensions of base, narrowest position 20 and open mouth 21 by sharply inclined portions of the wire angled relative to one another.

The dimension indicated at A that is the fullest extent at the open mouth defined by the open wires 11 is large enough to accept the base or bottom of the largest container or cup with which the support is proposed to be used. In practice the mouth will be of the order of 3 inches in diameter and preferably in the range of 1 to 8 inches.

The dimension indicated at B which is the smallest dimension or the diameter at the position of closest approach is arranged to be sufficiently small so that it is less than the transverse dimension of the smallest cup with which the support is designed to operate so that the cup can be clamped between the fingers provided by the wires 11.

The dimension indicated at C at the base is substantially equal to and slightly less than the dimension A so as again to accommodate the base or bottom of the largest cup.

The dimension indicated at D is arranged such that with the smallest cup with which the support is designed to operate, the position of the closest approach of the wires is arranged adjacent to the top of the cup but not beyond the top in order to contact and engage the cup in clamped relationship. In addition the height D should be sufficient to securely support the cup so that there is insufficient weight above the clamped position to allow the cup to tilt out of the clamping action provided at 20.

In practice, the dimension B is preferably of the order of 2 inches and can lie in the range of ½ to 7 inches. Also the height D is preferably of the order of 2½ inches and can lie in the range of 1 to 5 inches.

As illustrated in FIG. 3, a cup which is larger than the minimum has been placed on the base and therefore has flexed the fingers or wires as 11 outwardly so that the cup is clamped at 20. The base 10 is attached to a surface 2 by the adhesive layer 16.

Figure 1:
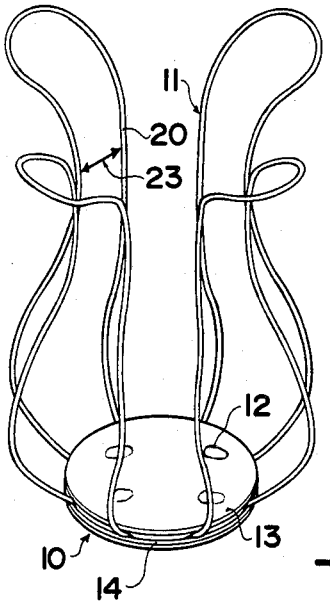
FIG. 1 is an isometric view of a first embodiment of container support according to the invention.

As illustrated in FIG. 1 there are four such fingers with spaces in between so that the hand of the user can engage the cup between the fingers and lift it from the clamping action. Also it will be noted that the wires as well as curving in the shape illustrated in FIGS. 2 and 3 also curve outwardly and then inwardly towards one another so that at the position 20 which is the minimum diameter, the wires are also at minimum spacing as indicated at 23. This provides a pleasing appearance and an effective clamping action.

Figure 4:
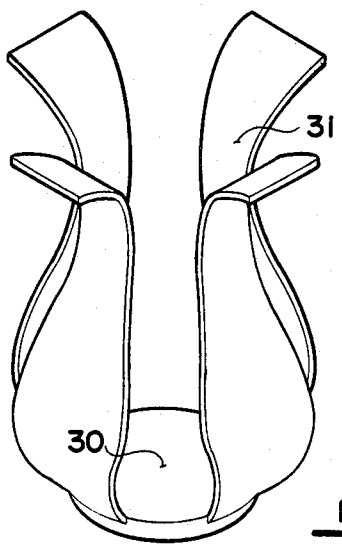
FIG. 4 is an isometric view of a modified embodiment molded integrally from plastics material.

A modified arrangement is illustrated in FIG. 4 and is manufactured by molding from an integral plastics material where the base indicated at 30 and the fingers 31 are integral.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A support for a single beverage container, comprising a base member sized to receive only the beverage container and having a substantially planar underside, activatible adhesive means on the underside of the base by which the base can be attached to a surface, and four support members upstanding from an upper side of the base for engaging and supporting sides of the container, the members being free to flex outwardly so as to accommodate containers of different outside dimensions, said members being formed by a single wire which is bent to form each of the members in turn with an interconnection between each member and the next adjacent member only at the base, each member comprising a loop of said wire defining two lower ends projecting into a peripheral edge surface of said base in a substantially horizontal direction, two generally upstanding legs and a transverse interconnecting portion at an upper end, said legs being shaped such that each turns from said horizontal lower end in an upward and inward direction to a position of closest approach of said members and then turned in an outward and upward direction to said interconnecting portion.

* * * * *